US009196144B2

(12) United States Patent
Vallance et al.

(10) Patent No.: US 9,196,144 B2
(45) Date of Patent: Nov. 24, 2015

(54) SOCIAL ALARM SYSTEM AND METHOD OF MONITORING A FALL DETECTOR UNIT IN A SOCIAL ALARM SYSTEM

(71) Applicant: Tunstall Group Limited, North Yorkshire (GB)

(72) Inventors: Clive John Vallance, Leeds (GB); Richard James Farrell-Smith, Leeds (GB)

(73) Assignee: TUNSTALL GROUP LIMITED, North Yorkshire (GB)

( * ) Notice: Subject to any disclaimer, the term of this patent is extended or adjusted under 35 U.S.C. 154(b) by 112 days.

(21) Appl. No.: 14/038,244

(22) Filed: Sep. 26, 2013

(65) Prior Publication Data

US 2014/0091934 A1 Apr. 3, 2014

(30) Foreign Application Priority Data

Oct. 1, 2012 (GB) ..... 1217529.5

(51) Int. Cl.
*G08B 23/00* (2006.01)
*G08B 21/04* (2006.01)

(52) U.S. Cl.
CPC ..... *G08B 21/0446* (2013.01); *G08B 21/043* (2013.01); *G08B 21/0415* (2013.01)

(58) Field of Classification Search
CPC ..... G08B 21/0446; G08B 21/0415; G08B 21/043; A41D 13/0506; A61B 2562/0216; A61B 5/1117; A61B 5/6831
See application file for complete search history.

(56) References Cited

U.S. PATENT DOCUMENTS

| | | | | |
|---|---|---|---|---|
| 2002/0118121 | A1* | 8/2002 | Lehrman et al. | 340/870.16 |
| 2007/0055146 | A1* | 3/2007 | Corlette et al. | 600/430 |
| 2008/0129518 | A1* | 6/2008 | Carlton-Foss | 340/573.1 |
| 2009/0121863 | A1 | 5/2009 | Prior | |
| 2009/0209830 | A1* | 8/2009 | Nagle et al. | 600/301 |
| 2010/0052896 | A1 | 3/2010 | Goodman | |
| 2012/0259577 | A1* | 10/2012 | Ganyi | 702/139 |
| 2013/0054180 | A1 | 2/2013 | Barfield et al. | |
| 2014/0052464 | A1* | 2/2014 | Ray | 705/2 |
| 2014/0266705 | A1* | 9/2014 | McKinley et al. | 340/539.13 |

FOREIGN PATENT DOCUMENTS

| | | | |
|---|---|---|---|
| DE | 102011004009 | A1 | 8/2012 |
| EP | 2306420 | A1 | 4/2011 |

* cited by examiner

*Primary Examiner* — Kerri McNally
*Assistant Examiner* — Renee Dorsey
(74) *Attorney, Agent, or Firm* — Murphy, Bilak & Homiller, PLLC

(57) ABSTRACT

The social alarm system includes a fall detector unit, worn by the user, having an accelerometer to detect a fall. A controller monitors for an acceleration signal which exceeds a wake-up or starting threshold and, in response, distinguishes between a fall event and a non-fall event based at least on the acceleration signal. A counter unit maintains a count of the non-fall events over a monitored time period such as one day. An alarm signal unit generates an inactivity alarm signal when the count of non-fall events is below a count threshold within the monitored time period.

20 Claims, 2 Drawing Sheets

SOCIAL ALARM SYSTEM AND METHOD OF MONITORING A FALL DETECTOR UNIT IN A SOCIAL ALARM SYSTEM

BACKGROUND

1. Technical Field

The present invention relates in general to the field of social alarm systems.

2. Description of Related Art

A social alarm system monitors the safety and wellbeing of a client in their dwelling. A social alarm client unit is installed in the dwelling and is arranged to initiate an alarm call to a remote monitoring centre apparatus when an alarm event is detected. As particular examples, the alarm may be triggered by the client pressing an alarm button on the social alarm client unit itself or on a personal radio trigger unit such as pendant.

The client unit may use data signalling to inform the server apparatus of the alarm event. The remote monitoring centre apparatus may allow an operator using a terminal to open a voice communication path and talk with the client via the client unit. The voice communication path is helpful in order to immediately reassure the client and assess their need for further care.

The system may include a fall detector unit which is arranged to detect that the client has fallen and trigger a corresponding fall alarm event via the social alarm client unit. The fall detector may be carried or worn by the client, and may be provided in various configurations, such as a belt, a wrist strap, or a pendant, among others. As will be familiar to those skilled in the art, each of these wearing configurations brings forward technical challenges in order to correctly distinguishing a fall from other physical activities of the client (e.g. bending, sitting). Generally, it is desired to correctly and reliably detect actual fall events, and to minimise false positives.

A difficulty arises in confirming that the fall detector unit is operating correctly and will trigger the fall alarm event when needed. Therefore, it is desired to provide an effective, reliable and cost-effective mechanism for monitoring the system, and in particular for monitoring and testing the social alarm client unit and the fall detector unit.

Generally, it is desired to address one or more of the disadvantages associated with the related art, whether those disadvantages are specifically discussed herein or will be otherwise appreciated by the skilled person from reading the following description.

SUMMARY OF THE INVENTION

According to the present invention there is provided an apparatus and method as set forth in the appended claims. Other features of the invention will be apparent from the dependent claims, and the description which follows.

In one example, the social alarm system includes a fall detector unit, worn by the user, having an accelerometer to detect a fall. A controller monitors for an acceleration signal which exceeds a wake-up or starting threshold and, in response, distinguishes between a fall event and a non-fall event based at least on the acceleration signal. A counter unit maintains a count of the non-fall events over a monitored time period such as one day. An alarm signal unit generates an inactivity alarm signal when the count of non-fall events is below a pre-set count threshold within the monitored time period.

In one implementation there is provided a social alarm system comprising a social alarm server apparatus and one or more social alarm client units connected thereto over a communications network. At least some of the client units are each associated with a fall detector unit. The social alarm client unit is configured to connect with the social alarm server apparatus over the communications network in response to an alarm event and to signal the social alarm server apparatus concerning the alarm event. The fall detector unit arranged to be carried by a user to detect a fall of the user. The fall detector unit comprises at least an accelerometer arranged to measure acceleration forces applied to the fall detector unit to provide an acceleration signal. The system further comprises a controller which, upon the acceleration signal exceeding a wake-up threshold, is arranged to distinguish between a fall event and a non-fall event based at least on the acceleration signal; a counter unit which is arranged to maintain a count of the non-fall events; and an alarm signal unit which is arranged to generate an inactivity alarm signal when the count of non-fall events is below a count threshold within a monitored time period.

In other aspects there are provided a server apparatus, a client unit and/or a fall detector unit configured to be used in the system set forth herein.

Suitably, the client unit and the fall detector unit are linked by wireless communication. In one example, the controller, the counter unit and the alarm signal unit are each provided within the fall detector unit and the fall detector unit is arranged to send the inactivity alarm signal to the client unit. Alternately, one or more of these units may be implemented within the client unit.

In one example, the client unit is arranged to respond to the inactivity alarm signal by determining an escalation action. A first escalation action may include issuing an audible or visual reminder signal for the user from the fall detector or from the client unit. A second escalation action may include triggering an alarm signal from the client unit to the social alarm server over the communications network. The client unit may determine the second escalation action by accumulating the inactivity alarm signals over a plurality of monitored time periods, e.g. by monitoring repeated inactivity alarm signals.

The client unit may be arranged to log a trend of the count of non-fall events for a plurality of monitored time periods. The client unit may report the log to the server or provide the log for analysis locally at the client unit. The client unit may determine a third escalation where the log reveals a decline in activity of the user.

In one implementation there is provided a method of monitoring a fall detector unit in a social alarm system. The method includes monitoring an acceleration signal of the fall detector unit; detecting one or more wakeup events upon a magnitude of the acceleration signal exceeding a wakeup threshold, classifying each event as being one of a fall event and a non-fall event by examining the acceleration signal, and incrementally increasing a non-fall count when the event is classified as being the non-fall event; checking the non-fall count against a count threshold over a monitored time period; and generating a fall detector unit inactivity alarm signal when the non-fall count is below the count threshold after expiry of the monitored time period.

In one example, the non-fall count and the monitored time period are reset after generating the inactivity alarm signal. One example includes resetting the non-fall count after expiry of the monitored time period. In some embodiments, the monitored time period comprises at least 12 hours, or at least 24 hours, or any multiple thereof.

In one example, a fall alarm signal is generated, suitably by the alarm signal unit, when the event is classified as being the fall event. The action of classifying each event may further comprise examining a barometric pressure signal from a barometer of the fall detector unit. The count threshold may be set, e.g. by receiving a setting into the client unit or delivering a setting from the client unit to the fall detector, to be applied for the next monitored time period.

In one example, the count threshold comprises a range of between greater than X and less than Y, where X and Y are both positive integers with Y being larger than X. In one example, the count threshold is set to Z or fewer non-fall events, where Z is a positive integer.

As will be discussed in more detail below, the example embodiments address many of the difficulties of the related art. These and other features and advantages will be appreciated further from the following example embodiments.

BRIEF DESCRIPTION OF THE DRAWINGS

For a better understanding of the invention, and to show how example embodiments may be carried into effect, reference will now be made to the accompanying drawings in which.

DETAILED DESCRIPTION

Figure 1:
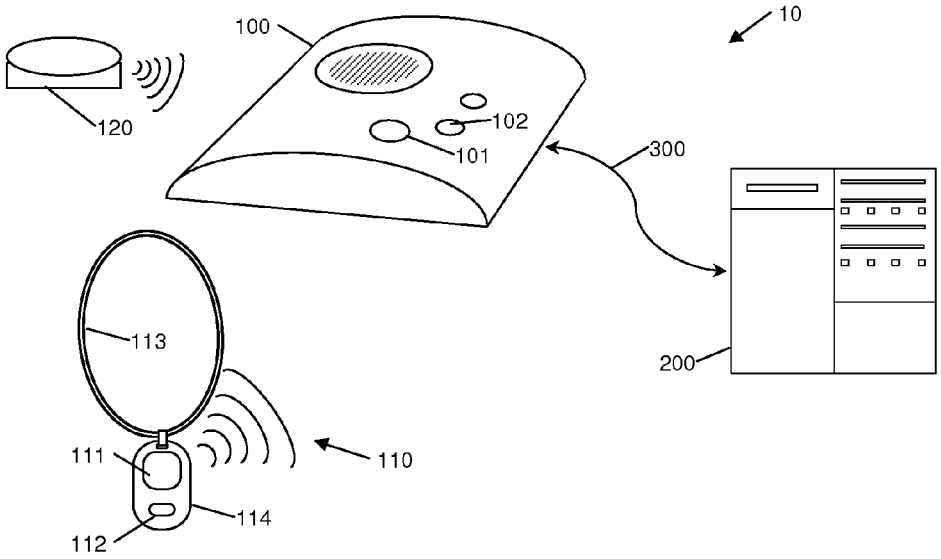
FIG. 1 is a schematic diagram of an example social alarm system.

The example embodiments will be described particularly with reference to the social alarm system shown in the drawings. The apparatus and method may be applied in many specific implementations, as will be apparent to persons skilled in the art from the teachings herein.

FIG. 1 is a schematic diagram showing an example social alarm system. In this example embodiment, the social alarm system 10 comprises a social alarm client unit 100 which is connected in use to social alarm server apparatus 200 at a remote monitoring centre through a communications channel 300. Suitably, the communications channel 300 is capable of carrying both voice signals and audio data signalling. The voice signals may be carried as an audio signal, and the data signalling may use in-band audio tones such as DTMF tones or other tones. The communications channel 300 suitably includes a telephone network. The telephone network may use land-lines (e.g. a plain old telephone systems POTS), cellular mobile telecommunications, or Voice-over-Internet Protocol (Vol P) communications.

As shown in FIG. 1, the example client unit 100 has a simple and straightforward user interface suitable for use by a wide range of people of differing abilities. Typically the client unit 100 includes, inter alia, a readily identified "alarm" button 101, so that the client may trigger an alarm event by manually pressing the alarm button on the client unit. The client unit may also include a "cancel" button 102, so that the client may cancel an unintentional alarm event, control the various functions of the client unit, or respond to verbal instructions provided by the care operator over the communications channel.

A fall detector unit 110 is configured to be worn or carried by the client. As examples, the fall detector unit 110 may be worn on the wrist or on a belt, or attached to a key ring, for example. In the example embodiments, the fall detector unit 110 is provided as a pendant worn around the neck of the client with a lanyard 113 supporting a main housing 114. In use, the housing 114 rests on the client's chest, suitably at or about their breastbone. In this configuration, the fall detector unit 110 is well placed to monitor and detect a fall event, while being relatively comfortable and unobtrusive for the client.

The fall detector unit 110 may also provide a personal radio trigger function, by incorporating an alarm button 111 so that the user may manually raise an alarm call even when they are not in close proximity to the client unit 100. The unit 110 may also include a cancel button 112 which, similar to the cancel button 102 on the client unit, may be used to cancel an unintentional alarm event.

The fall detector unit 110 is coupled to the client unit 100 by any suitable form of wireless communication. In one example embodiment, the fall detector unit 110 communicates with the client unit 100 over a short range wireless radio transmission, e.g. using an EN300 220-2: 2010 Category 1 radio receiver or radio transceiver.

In the example embodiment, the client unit 100 may also be coupled to one or more remote sensors 120. These sensors 120 may be provided at suitable locations around the dwelling of the client in order to monitor the daily activities of the client. The sensors 120 may include any suitable telecare sensor or combination of sensors. The remote sensors 120 may include bed/chair occupancy sensors, pressure mats, and/or environmental sensors (e.g. carbon monoxide, natural gas), amongst others. Suitably, the sensors 120 communicate with the client unit 100 over short range wireless radio transmission, or may be wired to the client unit 100.

The client unit 100 may thus raise various types of alarm events and signal these alarm events to the server apparatus 200, based on the activity of the client as monitored by the fall detector unit 110 and the remote sensors 120. Typically, the client unit 100 is configured to initiate an outgoing telephone call by seizing the telephone line (going off-hook) and dialling a pre-programmed telephone number of the remote monitoring centre where the server 200 is located. The server 200 answers the call and an audio path is established. Audio data signalling (e.g. DTMF or other tones) allows the client unit 100 to exchange data messages with the server 200 which notify the server 200 of (a) a serial number or identity of the client unit 100 making the call, and (b) the nature of the triggering event giving rise to the call. In response, the server 200 may log the call and transfer control of the telephone line to an operator, who may then speak to the client via the client unit 100.

Figure 2:
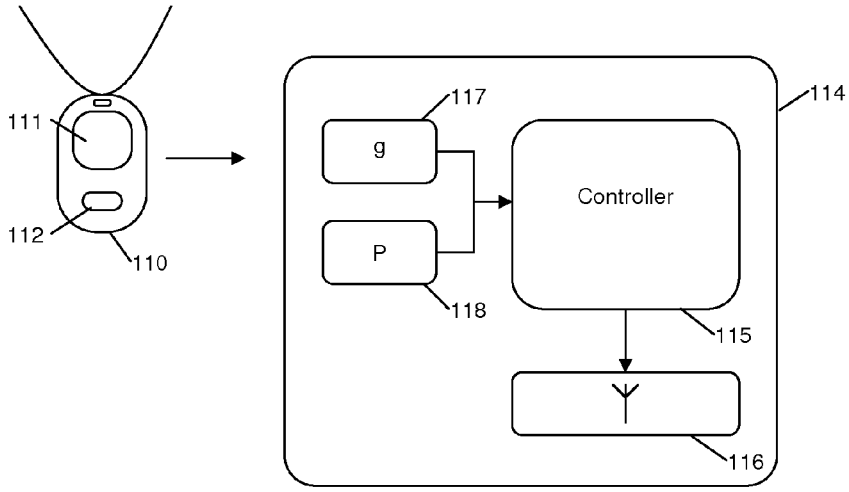
FIG. 2 is a schematic diagram showing an example internal configuration of a fall detector unit.

FIG. 2 is a schematic diagram showing an example internal configuration of the fall detector unit 110, in this example including a controller 115, a communication module 116, an accelerometer 117 and a barometer 118. As noted above, one or more buttons may be provided externally on the main housing 114, such an alarm button 111 and a cancel button 112.

The accelerometer 117 generates the acceleration signal g, which is conveniently a three-axis acceleration signal having x, y & z orthogonal axes. The acceleration signal may be provided as an acceleration vector. The controller 115 may collect the acceleration signal at regular intervals, e.g. at 100 times per second, and provide a temporary store or buffer for the acceleration signal over a period of interest which is sufficient to examine a potential fall event, such as a period of 1-10 seconds.

Optionally, the barometer 118 provides a pressure signal P based on atmospheric pressure around the fall detector unit 110. The pressure signal is likewise collected by the controller 115 at regular intervals and stored in a pressure signal buffer. The buffer again stores the pressure signal for a sufficient time period to examine a potential fall event, such as of the order of 1-10 seconds in length, with the pressure sensor 118 measuring at about 1 to 10 hertz.

Where the controller 115 determines that the magnitude of the acceleration signal g, i.e. the magnitude of the acceleration vector, has exceeded a shock threshold, then the controller 115 moves from a quiescent state to an examining state. In the examining state, the controller 1115 examines at least the acceleration signal to determine whether or not a fall event has been detected. In the example embodiments, the controller 115 determines either a fall-event or a non-fall event by examining both the pressure and acceleration signals during a time period after the shock threshold was exceeded.

In one example embodiment, the controller 115 determines a fall event by considering a change in angle of the acceleration vector between first and second time points, e.g. a first vector at time t=0 seconds and a second vector at time t=1 seconds, where t=0 is the time at which the magnitude of the acceleration vector first exceeded the shock threshold or wakeup threshold. A small change in angle would be consistent with an accidental knock or bump against the fall detector unit 110 and thus is not determined as a fall event (i.e. this event is instead classified as being a non-fall event). However, a large change in angle would be consistent with a fall, such as where the user topples forward or slumps backwards or collapses to the floor and rolls over, each causing a relatively large change in the orientation of the fall detector unit, which is thus confirmed as a fall event. Hence, the controller 115 examines the acceleration signal responsive to exceeding the wakeup threshold to classify this event as being one of a fall event and a non-fall event.

In the example embodiments, the pressure signal P from the barometer 118 is used to indicate a relative change in height of the fall detector 110 during an event. The change in pressure within the monitored period of interest is used by the controller 115 to further inform and determine whether a fall event or non-fall event has occurred. For example, a change in pressure indicating a change in height of more than say 1 meter would be consistent with a fall event, whilst a relatively constant pressure and thus constant height would indicate a non-fall event.

Figure 3:
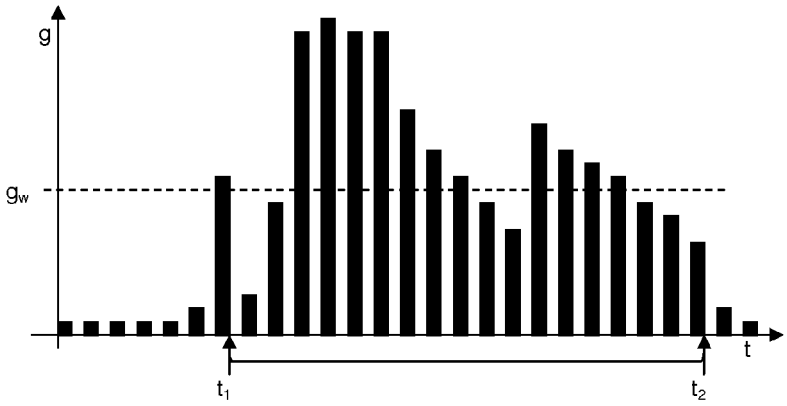
FIG. 3 is a graph showing an example acceleration signal over time.

FIG. 3 is a graph as an illustrative example of the acceleration signal g over a time period t. The graph shows a wake-up point at a time $t_1$ when the magnitude of the acceleration signal exceeds the wakeup threshold $g_w$, followed by an examination period until time $t_2$ wherein the controller 115 examines at least the acceleration signal g to determine a fall or non-fall outcome of this wake-up event.

Figure 4:
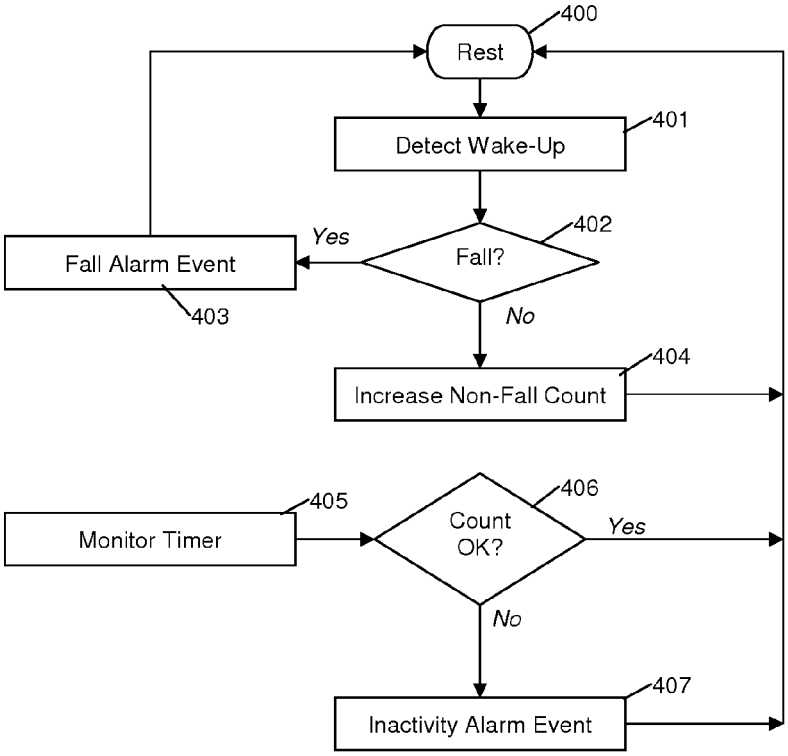
FIG. 4 is a schematic flowchart of an example method of monitoring a fall detector unit in a social alarm system.

FIG. 4 is a flow chart illustrating an exampled method which is suitably applied within the fall detector unit 110, or by the fall detector 110 in cooperation with the client unit 100.

The method suitably comprises monitoring at least the acceleration signal when in a resting state at step 400. A wakeup condition is detected at step 401, suitably when the magnitude of the acceleration signalling exceeds the wakeup threshold. Step 402 involves examining the signals received by the fall detector to decide a fall event or a non-fall event, including particularly examining the acceleration signal and optionally also considering a pressure signal as noted above. Where a fall event is determined, then a fall alarm signal is suitably generated at step 403. However, where a non-fall event is determined then a non-fall count is increased at step 404.

Step 405 involves providing a timer to control a monitored time period. The timer is reset suitably at regular intervals, such as every 24 hours, and may also be reset, for example, each time an alarm event occurs. When the monitored period expires, e.g. after 24 hours, step 406 compares the currently held non-fall count against a count threshold. Where the non-fall count is satisfactory, by being greater than the threshold, then the count may be reset and the method may begin again from resting at step 400. However, where the currently established non-fall count is not satisfactory when compared with the threshold, by being less than the threshold, then an inactivity alarm event is generated at step 407.

In normal use, it is to be expected that the acceleration signal will exceed the wakeup threshold at least once per day, and more commonly between about five and about ten times per day, in response to the ordinary daily living activities of the user. That is, as the user performs their normal daily activity then the fall detector unit will register an acceleration signal in excess of the wakeup threshold one or more times. Even though a non-fall event is determined and the fall detector will then return to the quiescent state without actively raising a fall alarm, these non-fall events are actually useful in monitoring the activity of the client and confirming reliable operation of the fall detector 110.

Firstly, it is possible that the fall detector unit has become faulty and is not registering or responding to the acceleration signal at all times or in a sufficient way. In which case, it is desirable to register an alert so that the fall detector unit can be examined and repaired. Alternately, it is possible that the fall detector unit is working perfectly but is not worn by the user for some periods of the day and thus, during these times, the fall detector unit remains relatively stationary (e.g. placed on a table). In which case, the alert serves as a reminder that the user should wear the fall detector unit more consistently.

In the example embodiments, the inactivity alarm event of step 407 regarding the fall detector 110 may cause the client unit 100 to generate a local alert message for the user, or may cause the client unit 100 to trigger an alarm signal to the remote server apparatus 200.

The client unit 100 suitably generates an alert locally, such as through a visual display feedback or audible feedback, to alert the user that the inactivity condition has been detected by the fall detector unit 110. In particular, the inactivity condition may indicate that the fall detector 110 is not being worn sufficiently by the user. Suitably, as a first stage of escalation, the client unit 100 issues a reminder message which reminds the user to wear the fall detector unit 110.

As a second stage of escalation, such as where two inactivity events are determined on subsequent days, the client unit 100 may signal a background alert event to the remote server apparatus 200 across the communications channel 300. Thus, the server apparatus 200 is informed of the detected relative inactivity of the fault detector 110.

Suitably, a continued reduced number of non-fall events indicates that further intervention is required, in which case the client unit is arranged to generate an outgoing signal to the server apparatus drawing attention to the detected inactive condition. For example, where the inactive condition is detected for two consecutive days then an alert is generated to the server apparatus. Such an alert allows early intervention to ensure that the user is well and will continue to wear the fall detector.

Where at least one or more non-fall events are detected within the monitored period, i.e. within one day, that would indicate that the fall detector unit is operating correctly. However, where the number of counted non-fall events is below the intended threshold, e.g. greater than one but less than 5, then it is likely to be caused by the user themselves becoming relatively inactive, e.g. sitting or sleeping for long periods rather than moving from room to room, cooking and so on. Thus, the number of non-fall events is interesting both in the short term, within one day or several days, and is also of interest for longer term monitoring over many weeks or months, as a potential warning sign of decreasing daily activity. Hence, the example embodiments have important practical advantages in providing an improved social alarm system.

The industrial application of the present invention will be clear from the discussion above. Likewise, the many advantages of the invention will be apparent from these embodiments and/or from practicing the example embodiments of the invention.

Although a few preferred embodiments have been shown and described, it will be appreciated by those skilled in the art that various changes and modifications might be made without departing from the scope of the invention, as defined in the appended claims.

The invention claimed is:

1. A social alarm system, comprising:

a social alarm server apparatus;

a social alarm client unit which is configured to connect with the social alarm server apparatus over a communications network in response to an alarm event and to signal the social alarm server apparatus concerning the alarm event; and a fall detector unit, arranged to be carried by a user, comprising an accelerometer arranged to measure acceleration forces to provide an acceleration signal;

a controller which, upon the acceleration signal exceeding a shock threshold representing a potential fall event, is arranged to classify the potential fall event as being one of a fall event and a non-fall event, based at least on examining the acceleration signal;

a counter unit which is arranged to maintain a count of the non-fall events; and an alarm signal unit which is arranged to generate an inactivity alarm signal when the count of non-fall events is below a count threshold within a monitored time period.

2. The social alarm system of claim 1, wherein the controller, the counter unit and the alarm signal unit are each provided within the fall detector unit, and the fall detector unit is arranged to send the inactivity alarm signal to the client unit.

3. The social alarm system of claim 2, wherein the client unit is arranged to receive the inactivity alarm signal from the fall detector unit.

4. The social alarm system of claim 3, wherein the client unit is configured to perform a first escalation action including issuing an audible or visual reminder signal for the user.

5. The social alarm system of claim 3, wherein the client unit is configured to perform a second escalation action including triggering an alarm signal to the social alarm server.

6. The social alarm system of claim 5, wherein the client unit is configured to perform the second escalation action after accumulating the inactivity alarm signals over a plurality of monitored time periods.

7. The social alarm system of claim 1, wherein the client unit is arranged to log a trend of the count of non-fall events for a plurality of monitored time periods.

8. A fall detector device which is configured to be carried in use by a user, comprising:

an accelerometer arranged to measure acceleration forces to provide an acceleration signal;

a controller which, upon the acceleration signal exceeding a shock threshold representing a potential fall event, is arranged to classify the potential fall event as being one of a fall event and a non-fall event, based at least on examining the acceleration signal;

a counter unit which is arranged to maintain a count of the non-fall events; and an alarm signal unit which is arranged to generate an inactivity alarm signal when the count of non-fall events is below a count threshold within a monitored time period.

9. The fall detector device of claim 8, wherein the fall detector device comprises a communication module configured to send the inactivity alarm signal by wireless communication.

10. A method of monitoring a fall detector unit in a social alarm system, comprising:

monitoring an acceleration signal at the fall detector unit to detect potential fall events in which the acceleration signal exceeds a shock threshold defined as representing a potential fall;

classifying each potential fall event as being one of a fall event and a non-fall event by examining at least the acceleration signal, and incrementally increasing a non-fall count when the potential fall event is classified as being the non-fall event;

checking the non-fall count against a count threshold over a monitored time period; and outputting an inactivity alarm signal when the non-fall count is below the count threshold after expiry of the monitored time period.

11. The method of claim 10, further comprising resetting the non-fall count and the monitored time period after generating the inactivity alarm signal.

12. The method of claim 10, further comprising resetting the non-fall count after expiry of the monitored time period.

13. The method of claim 10, wherein the monitored time period comprises at least twelve hours.

14. The method of claim 10, further comprising generating a fall alarm signal when the potential fall event is classified as being the fall event.

15. The method of claim 10, wherein the step of classifying each potential fall event further comprises examining a barometric pressure signal in conjunction with examining the acceleration signal.

16. The method of claim 10, further comprising setting the count threshold for a next monitored time period.

17. The method of claim 10, wherein the count threshold comprises a range of between greater than X and less than Y, where X and Y are both positive integers with Y being larger than X.

18. The method of claim 10, further comprising sending the inactivity alarm signal by wireless communication from the fall detector device to a client unit.

19. The method of claim 10, further comprising issuing at least one of an audible reminder signal and a visual reminder signal to a user in response to the inactivity alarm signal.

20. The method of claim 10, further comprising triggering an alarm signal from a client unit to a social alarm server in response to the inactivity alarm signal.

* * * * *